US010241447B2

(12) United States Patent
Kishi

(10) Patent No.: US 10,241,447 B2
(45) Date of Patent: Mar. 26, 2019

(54) IMAGE FORMING APPARATUS HAVING A HEAT INSULATION DUCT THAT DISCHARGES A COOLING MEDIUM

(71) Applicant: Konica Minolta, Inc., Chiyoda-ku, Tokyo (JP)

(72) Inventor: Hidehito Kishi, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/944,846

(22) Filed: Apr. 4, 2018

(65) Prior Publication Data

US 2018/0307163 A1 Oct. 25, 2018

(30) Foreign Application Priority Data

Apr. 20, 2017 (JP) ..... 2017-083890

(51) Int. Cl.

*G03G 15/20* (2006.01)
*G03G 21/20* (2006.01)
*G03G 21/00* (2006.01)

(52) U.S. Cl.

CPC ..... *G03G 15/2017* (2013.01); *G03G 21/206* (2013.01); *G03G 21/0011* (2013.01)

(58) Field of Classification Search

CPC ..... G03G 15/2017
USPC ..... 399/92
See application file for complete search history.

(56) References Cited

U.S. PATENT DOCUMENTS

2015/0241824 A1* 8/2015 Sekiya ..... G03G 15/2039 399/69
2017/0090417 A1* 3/2017 Yoshioka ..... G03G 21/206

FOREIGN PATENT DOCUMENTS

JP 6-236083 A 8/1994
JP 10-228227 A 8/1998
JP 2006-18074 A 1/2006

* cited by examiner

*Primary Examiner* — Walter L Lindsay, Jr.
*Assistant Examiner* — Philipmarcus T Fadul
(74) *Attorney, Agent, or Firm* — Buchanan Ingersoll & Rooney PC

(57) ABSTRACT

An image forming apparatus includes: an image former that includes an imaging part that forms a toner image; a fixing apparatus that fixes the toner image transferred to a sheet by a heating roller and a pressure roller extending in an axial direction; and a heat insulation duct that is disposed between the image former and the fixing apparatus and introduces a cooling medium therein along the axial direction, wherein the heat insulation duct has an opening portion that discharges the cooling medium introduced into the heat insulation duct to a region between the image former and the fixing apparatus.

12 Claims, 9 Drawing Sheets

IMAGE FORMING APPARATUS HAVING A HEAT INSULATION DUCT THAT DISCHARGES A COOLING MEDIUM

The entire disclosure of Japanese patent Application No. 2017-083890, filed on Apr. 20, 2017, is incorporated herein by reference in its entirety.

BACKGROUND

Technological Field

The present invention relates to an image forming apparatus. The image forming apparatus includes electrophotographic apparatuses such as a digital copying machine, a facsimile machine and a printer, a recording device, a display apparatus and the like regardless of color or monochrome.

Description of the Related Art

In the image forming apparatus, when the temperature of an image forming region other than a fixing apparatus rises due to hot air warmed by the fixing apparatus, various kinds of problems have been known to occur, such as toner aggregation in a cleaner and expansion of a transfer belt, thereby deteriorating the running accuracy.

To solve this problem, JP 6-236083 A describes an image forming apparatus in which a heat insulation structure is disposed at a portion facing a fixing apparatus. As the heat insulation structure, a hollow double wall structure or a heat insulation member is provided.

JP 10-228227 A describes an image forming apparatus in which, a duct for guiding cooling air is provided between a fixing apparatus and the peripheral portions thereof. For this duct, a metal member, which is a part of a reinforcing member, is used near the fixing apparatus, and a resin member is used far from the fixing apparatus.

JP 2006-18074 A describes an image forming apparatus which adopts a structure in which air discharged from an air duct is divided into upper and lower portions not for the purpose of heat insulation between a fixing apparatus and a process region, and the upper portion is discharged toward the surface of a sensitive body to separate the leading edge of a sheet, and the lower portion is discharged toward a sheet conveying path to prevent the leading edge of the sheet from being turned up.

In recent years, downsizing of the image forming apparatus has been advanced, and the gap between the fixing apparatus and the peripheral portions thereof tends to be narrowed. As a result, to avoid the influence of the hot air warmed by the fixing apparatus on the image forming region, the configurations disclosed in JP 6-236083 A and JP 10-228227 A are insufficient.

SUMMARY

The present invention has been made in light of the above problems, and an object of the present invention is to provide an image forming apparatus having a configuration capable of more effectively avoiding the influence of the hot air warmed by the fixing apparatus on the image forming region.

To achieve the abovementioned object, according to an aspect of the present invention, an image forming apparatus reflecting one aspect of the present invention comprises: an image former that includes an imaging part that forms a toner image; a fixing apparatus that fixes the toner image transferred to a sheet by a heating roller and a pressure roller extending in an axial direction; and a heat insulation duct that is disposed between the image former and the fixing apparatus and introduces a cooling medium therein along the axial direction, wherein the heat insulation duct has an opening portion that discharges the cooling medium introduced into the heat insulation duct to a region between the image former and the fixing apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
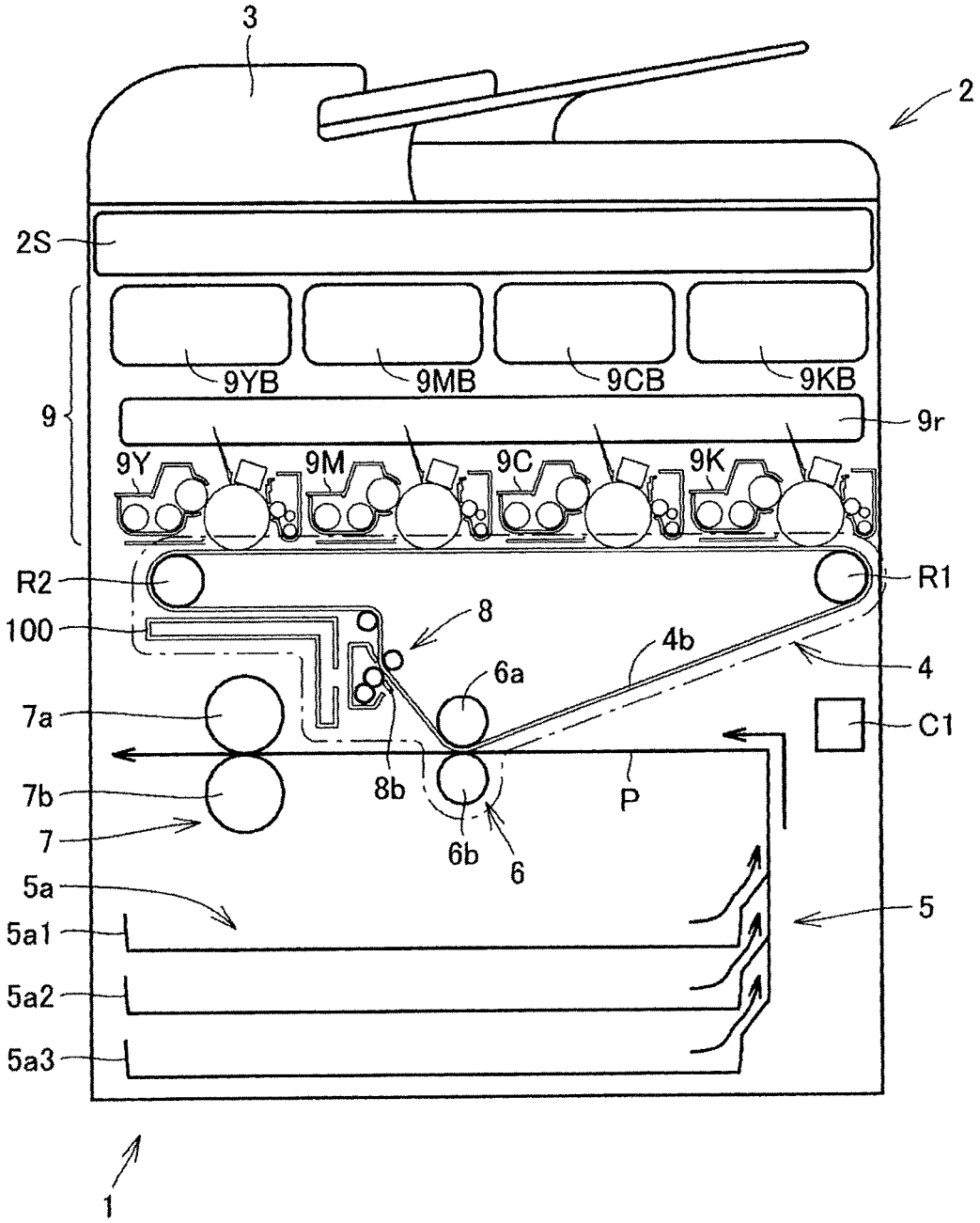
FIG. 1 is a schematic diagram showing the internal configuration of an image forming apparatus according to a first embodiment.

Hereinafter, an image forming apparatus according to one or more embodiments of the present invention will be described with reference to the drawings. However, the scope of the invention is not limited to the disclosed embodiments. In the embodiments described below, when the number, amount and the like are referred, the scope of the present invention is not necessarily limited to the number, amount and the like unless otherwise stated. Identical parts and equivalent parts are denoted by the same reference numerals, and redundant explanations may be not repeated. In the drawings, there are portions shown without the ratios of the actual dimensions and shown with the changed ratios so that the structures become clear to facilitate the understanding of the structures.

The image forming apparatus includes a multi function peripheral (MFP) provided with a scanner function, a copying function, a function as a printer, a facsimile function, a data communication function and a server function.

First Embodiment

Figure 2:
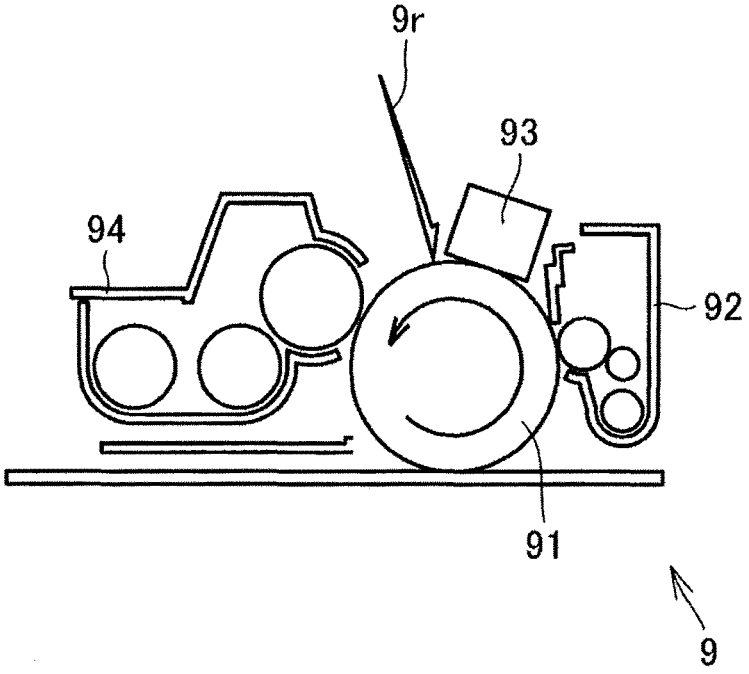
FIG. 2 is a schematic diagram showing the configuration of an imaging part according to the first embodiment.

With reference to FIGS. 1 and 2, an image forming apparatus 1 according to a first embodiment will be described. FIG. 1 is a schematic diagram showing the internal configuration of the image forming apparatus 1, and FIG. 2 is a diagram showing the schematic configuration of an imaging part. This image forming apparatus 1 is a so-called a multi function peripheral (MFP) capable of executing copy jobs, print jobs, scan jobs, fax jobs and box jobs. The box jobs are jobs executed by using data stored in a box (folder) provided in the image forming apparatus 1.

This image forming apparatus 1 is mainly configured with an image former 4, an automatic document conveying unit 3, a document reading unit 2 and a paper feeding unit 5 and executes image formation based on print settings. The document reading unit 2 includes a scanner 2S. The automatic document conveying unit 3 automatically conveys a document placed on the scanner 2S to a reading position of the document reading unit 2. The document reading unit 2 reads an image of the document conveyed by the automatic document conveying unit 3 and generates read data. The paper feeding unit 5 includes a plurality of paper feeding units 5 and supplies sheets P accommodated in the respective paper feeding units 5 to the image former 4. In the present embodiment, the paper feeding unit 5 has a first paper feeding unit 5*a*1, a second paper feeding unit 5*a*2 and a third paper feeding unit 5*a*3.

The image former 4 forms an image on the sheet P supplied from the paper feeding unit 5 based on the read data generated by the document reading unit 2 or print data acquired by a data interface (IF) unit.

The image former 4 includes an exposure unit 9*r*, a yellow (Y) imaging part 9Y, a magenta (M) imaging part 9M, a cyan (C) imaging part 9C and a black (K) imaging part 9K. A yellow (Y) toner bottle 9YB is disposed above the yellow (Y) imaging part 9Y, a magenta (M) toner bottle 9MB is disposed above the magenta (M) imaging part 9M, a cyan (C) toner bottle 9CB is disposed above the cyan (C) imaging part 9C, and a black (K) toner bottle 9KB is disposed above the black (K) imaging part 9K.

The image former 4 includes an intermediate transfer body 4*b*, a pair of registration rollers R1 and R2, a secondary transferrer 6, a cleaner 8 and a fixing apparatus 7, which are common to the Y to K colors.

With reference to FIG. 2, the configuration of each imaging part will be described. A cleaner 92, a charging unit 93, the exposure unit 9*r* and a development unit 94 are disposed along the rotation direction of a photoreceptor 91.

A toner image of the Y to K colors is formed on the intermediate transfer body 4*b* by synchronizing the timings so that toner images of the corresponding pixels overlap with each other for the images formed by the imaging parts of the respective colors.

The pair of registration rollers R1 and R2 corrects the skew of the sheet P supplied from the paper feeding unit 5 and conveys the sheet P to the secondary transferrer 6 at the timing so that the toner image transferred onto the intermediate transfer body 4*b* come to a predetermined position on the sheet P. The secondary transferrer 6 has a pair of transfer rollers 6*a* and 6*b* and secondarily transfers the toner image on the intermediate transfer body 4*b* onto the sheet P. The toner image remaining on the intermediate transfer body 4*b* is removed by using a squeegee 8*b* provided in the cleaner 8.

The fixing apparatus 7 fixes the toner image transferred onto the sheet P. The fixing apparatus 7 includes a heating roller 7*a* and a pressure roller 7*b*. The heating roller 7*a* and the pressure roller 7*b* are in pressure contact with each other to form a fixing nip portion, and the toner image is fixed by passing the sheet P through the fixing nip portion.

The sheet P on which the toner image has been fixed on the front surface by the fixing apparatus 7 is directly discharged in one-side printing. In double-side printing, the sheet P is conveyed again to the secondary transferrer via a turnover conveying path and discharged after the image is formed on the back surface.

(Heat Insulation Duct 100)

Figure 3:
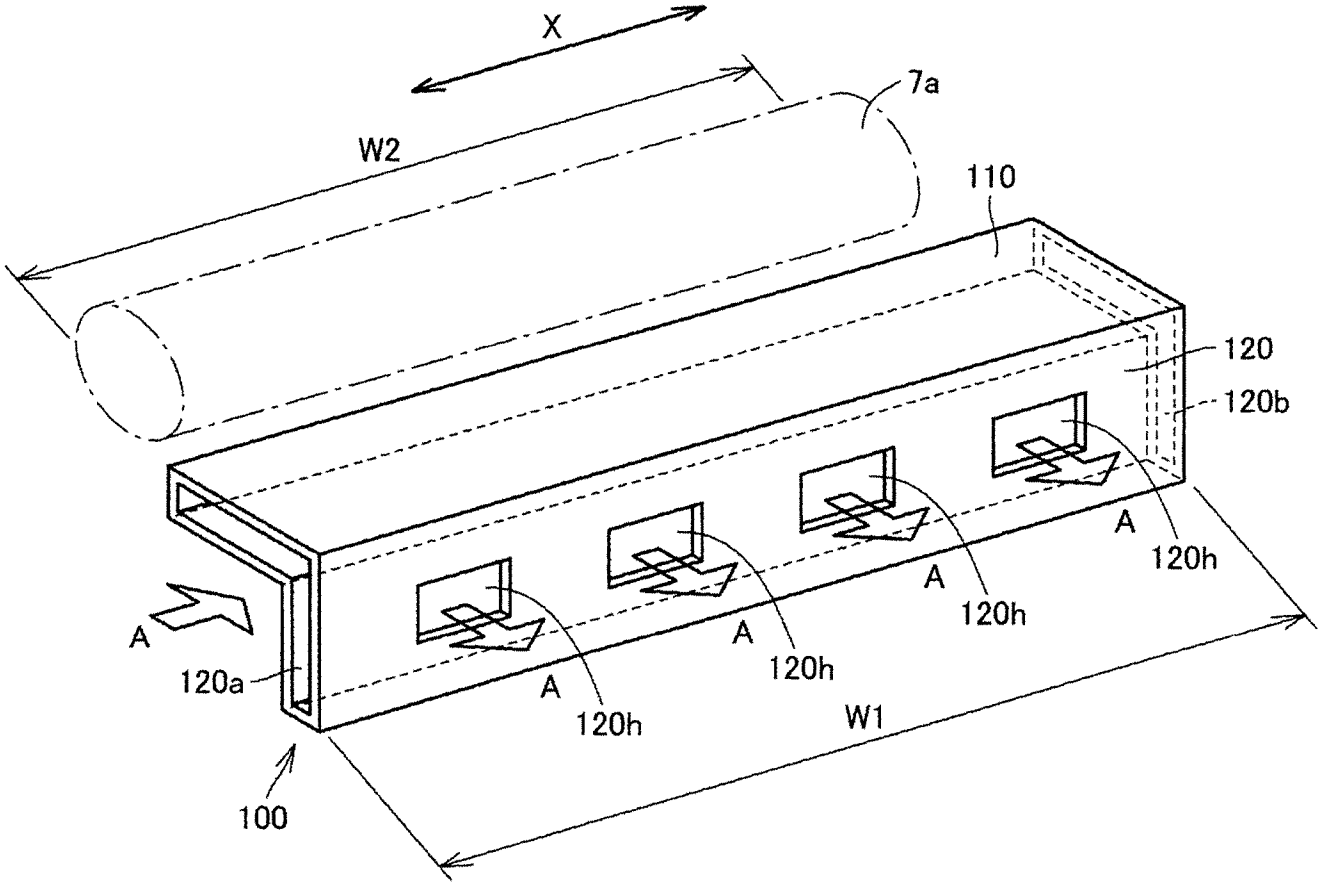
FIG. 3 is a general perspective view showing the configuration of only a heat insulation duct according to the first embodiment.

Hereinafter, the configuration of a heat insulation duct 100 in the present embodiment will be described with reference to FIG. 3. FIG. 3 is a general perspective view showing the configuration of only the heat insulation duct 100. In the image forming apparatus 1 according to the present embodiment, the heat insulation duct 100 is provided between the fixing apparatus 7 and the image former 4.

This heat insulation duct 100 suppresses the heat generated by the fixing apparatus 7 from reaching the image former 4. Herein, the image former 4 means a region including apparatuses other than the fixing apparatus 7 until the image is transferred to the sheet P. In the present embodiment, the image former 4 includes, for example, the cleaner 8, the secondary transferrer 6, the intermediate transfer body 4*b* and the pair of registration rollers R1 and R2.

Referring to FIG. 3, the heat insulation duct 100 has a cylindrical shape extending in a direction the same as the axial directions (direction indicated by the arrow X in FIG. 3) of the heating roller 7*a* and the pressure roller 7*b* of the fixing apparatus 7. The heat insulation duct 100 includes a first duct 110 extending in the horizontal direction and a second duct 120 extending in the vertical direction when viewed from the entire image forming apparatus 1. The first duct 110 covers the upper side of the fixing apparatus 7, and the second duct 120 is provided between the fixing apparatus 7 and the cleaner 8 so as to cover a side of the heating roller 7*a* of the fixing apparatus 7.

A width (W1) of the heat insulation duct 100 along the axial direction (direction indicated by the arrow X in FIG. 3) of the heating roller 7*a* is preferably longer than a width (W2) of the fixing apparatus 7 (heating roller 7*a*). Thus, the hot air warmed by the fixing apparatus 7 (heating roller 7*a*) can be blocked by the heat insulation duct 100.

The first duct 110 and the second duct 120 in the present embodiment have hollow shapes, are provided with a first end opening 120*a* and a second end opening 120*b* at both ends and can send air as a cooling medium into the insides of the first duct 110 and the second duct 120. In the present embodiment, the openings are provided at both ends, but an opening which can send in the air may be provided at one of the ends. In addition, although the air is an example of the cooling medium in this case, the cooling medium may be an inert gas such as nitrogen.

Moreover, the second duct 120 is provided with a plurality of main body opening portions 120*h* along the axial direction. The main body opening portions 120*h* face the cleaner 8 and are provided at a position not facing the fixing apparatus 7. In the present embodiment, four main body opening portions 120*h* are provided, but the number to be provided can be appropriately changed.

By providing the plurality of main body opening portions 120*h* in this manner, the air sent into the heat insulation duct 100 is discharged toward the cleaner 8 provided in the image former 4. As a result, the air discharged from the main body opening portions 120*h* contacts the cleaner 8 and then diffuses in all directions through the gap. The air diffused in this manner acts as if the air plays a role of an air curtain and suppresses the hot air warmed by the fixing apparatus 7 from reaching the image former 4.

In addition, since the air discharged from the main body opening portions 120*h* is in contact with the cleaner 8, cooling effects on the cleaner 8 and the intermediate transfer body 4*b* can be expected.

Second Embodiment

Figure 4:
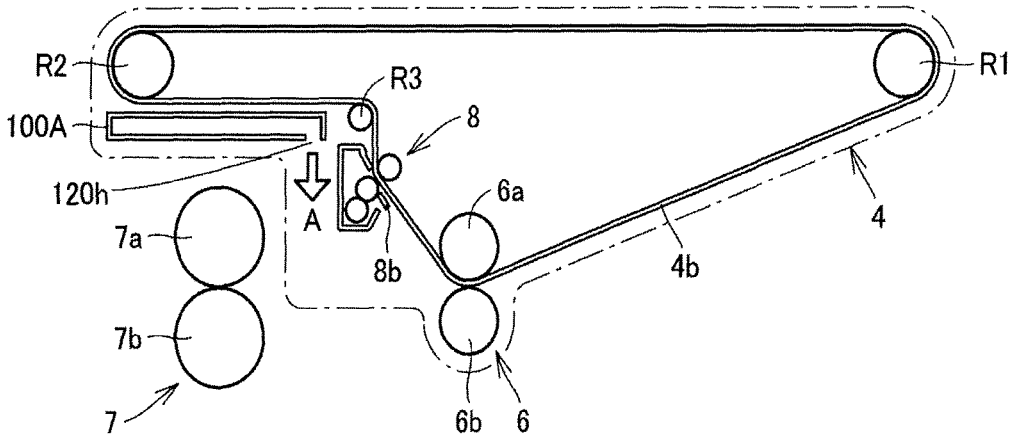
FIG. 4 is a schematic diagram showing only the internal configuration of an image forming apparatus according to a second embodiment.

With reference to FIG. 4, an image forming apparatus 1 according to a second embodiment will be described. The difference between the image forming apparatuses 1 of the first and second embodiments is a difference in the configuration of a heat insulation duct 100A. Hereinafter, only the configuration of the heat insulation duct 100A will be described. FIG. 4 is a schematic diagram showing only the internal configuration of the image forming apparatus 1.

The heat insulation duct 100A of the second embodiment has a structure with only the first duct 110 and without the second duct 120 as compared with the heat insulation duct 100 of the first embodiment. A main body opening portion 120*h* is provided at the first duct 110, but the plurality of main body opening portions 120*h* may be provided as in the first embodiment, or one continuous opening portion may be provided.

The air discharged from the main body opening portion 120*h* plays a role of an air curtain by passing between the fixing apparatus 7 and the image former 4, particularly between the fixing apparatus 7 and the cleaner 8, and suppresses the hot air warmed by the fixing apparatus 7 from reaching the image former 4.

Third Embodiment

Figure 5:
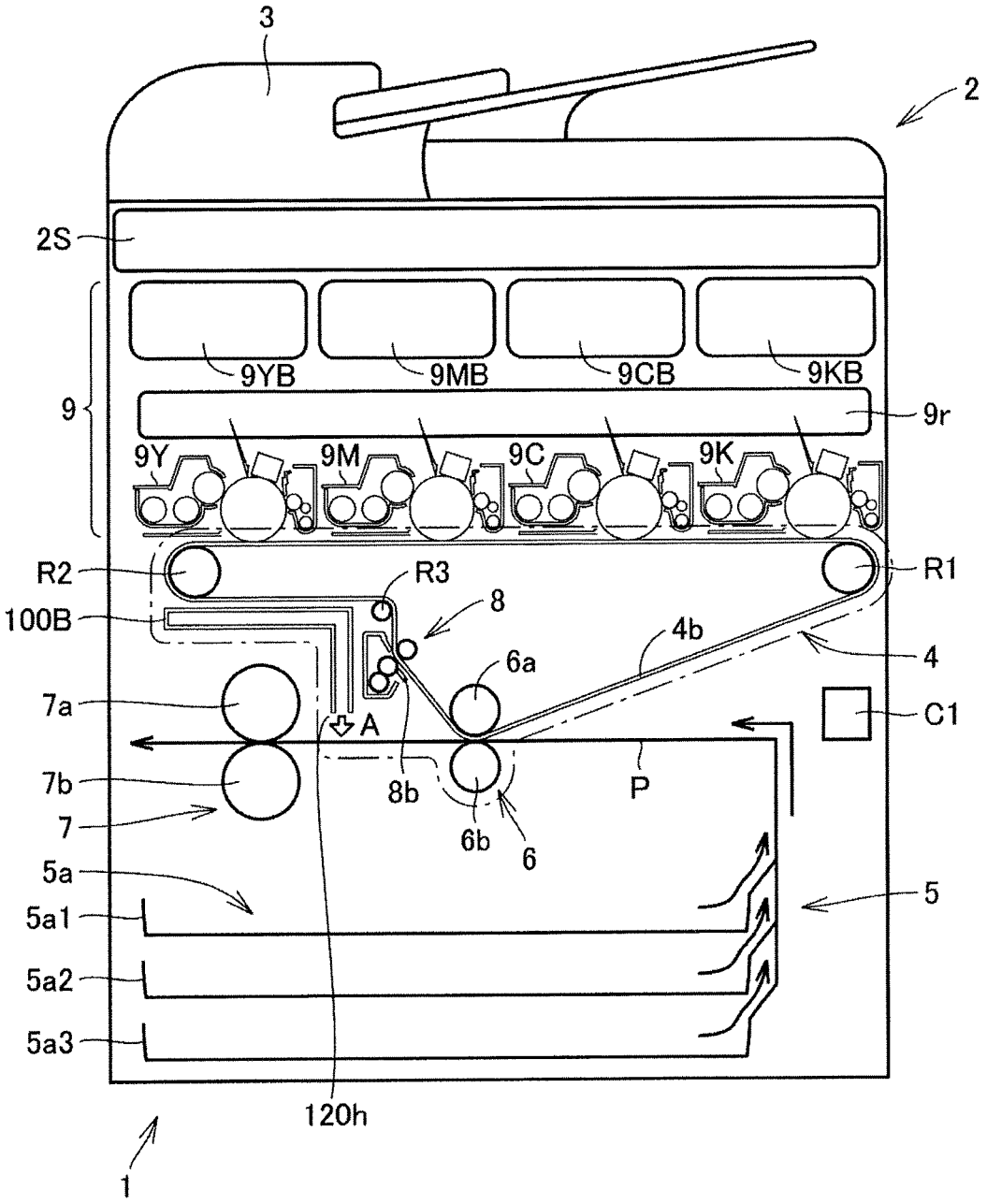
FIG. 5 is a schematic diagram showing only the internal configuration of an image forming apparatus according to a third embodiment.

With reference to FIG. 5, an image forming apparatus 1 according to a third embodiment will be described. The difference between the image forming apparatuses 1 of the first and third embodiments is a difference in the configuration of a heat insulation duct 100B. Hereinafter, only the configuration of the heat insulation duct 100B will be described. FIG. 5 is a schematic diagram showing only the internal configuration of the image forming apparatus 1.

The heat insulation duct 100B in the third embodiment is different from the heat insulation duct 100 in the first embodiment in a position where a main body opening portion 120*h* is provided. In the present embodiment, the main body opening portion 120*h* is provided at the lower end of the second duct 120. As in the first embodiment, the plurality of main body opening portions 120*h* may be provided, or one continuous opening portion may be provided.

The air discharged from the main body opening portion 120*h* plays a role of an air curtain by passing between the fixing apparatus 7 and the image former 4, particularly between the fixing apparatus 7 and the cleaner 8, and suppresses the hot air warmed by the fixing apparatus 7 from reaching the image former 4. Moreover, since the air passes through the inside of the second duct 120 for a long time, the air discharged from the main body opening portion 120*h* at the lower end of the second duct 120 is maintained at a low temperature, the hot air warmed by the fixing apparatus 7 is more effectively suppressed from reaching the image former 4.

Fourth Embodiment

Figure 6:
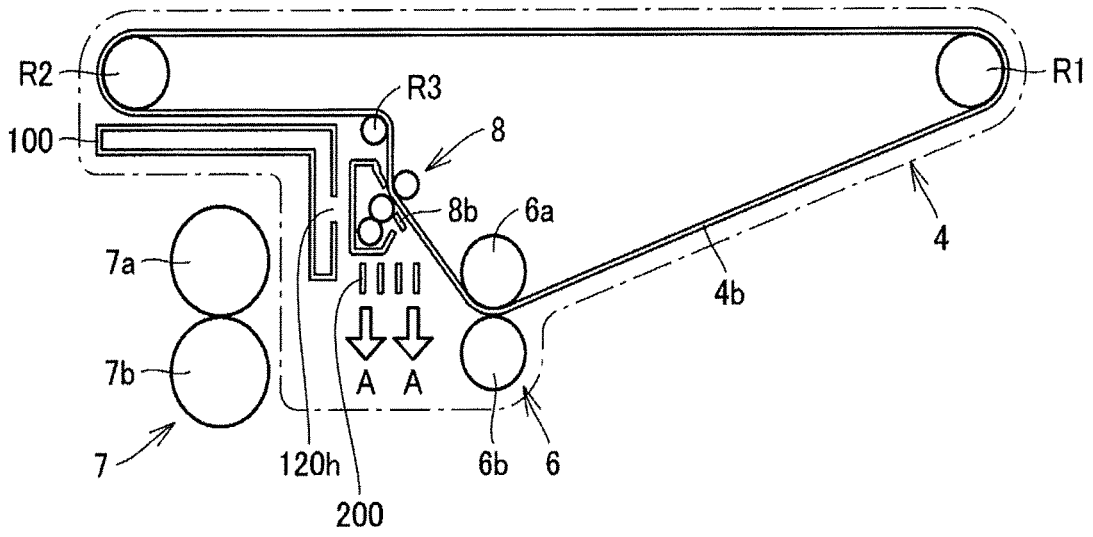
FIG. 6 is a schematic diagram showing only the internal configuration of an image forming apparatus according to a fourth embodiment.
Figure 7:
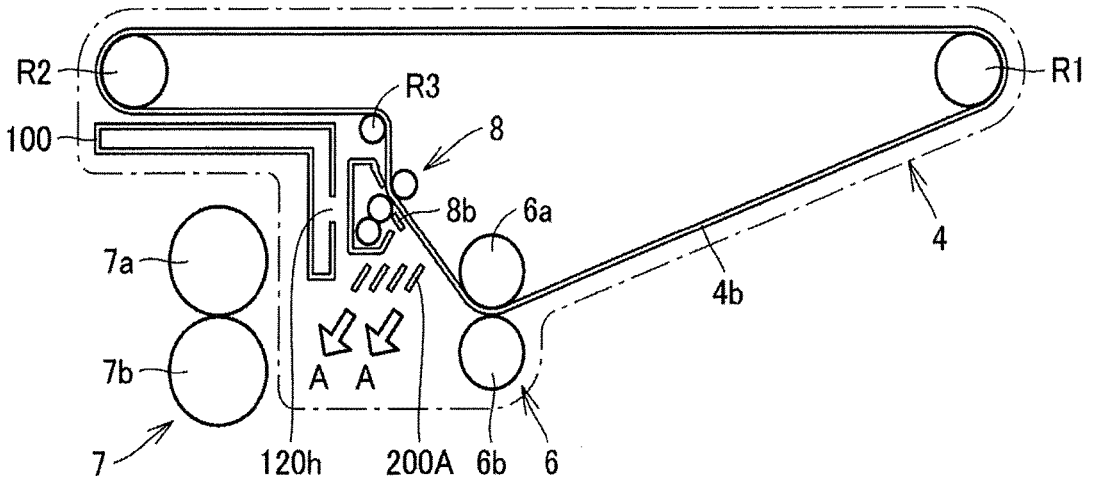
FIG. 7 is a schematic diagram showing only the internal configuration of an image forming apparatus according to another embodiment of the fourth embodiment.

With reference to FIGS. 6 and 7, an image forming apparatus 1 according to a fourth embodiment will be described. The difference between the image forming apparatuses 1 of the first and fourth embodiments is that fins 200 are additionally disposed in the image forming apparatus 1 of the fourth embodiment to adjust the flow direction of the air discharged from the main body opening portion 120*h*. FIG. 6 is a schematic diagram showing only the internal configuration of the image forming apparatus 1, and FIG. 7 is a schematic diagram showing only the internal configuration of an image forming apparatus 1 according to another embodiment.

As the fins 200, a plurality of so-called louver type fins extending in the axial direction (direction indicated by the arrow X in FIG. 3) of the heating roller 7*a* are arranged. By disposing the fins 200 in this manner, it is possible to control the flow of the air discharged from the main body opening portion 120*h*. For example, as shown in FIG. 7, by inclining the direction of the fins 200 toward the fixing apparatus 7, it is possible to guide the flow of the air discharged from the main body opening portion 120*h* to the fixing apparatus 7. Thus, the hot air warmed by the fixing apparatus 7 (heating roller 7*a*) can be more effectively prevented from flowing toward the image former 4.

Fifth Embodiment

Figure 8:
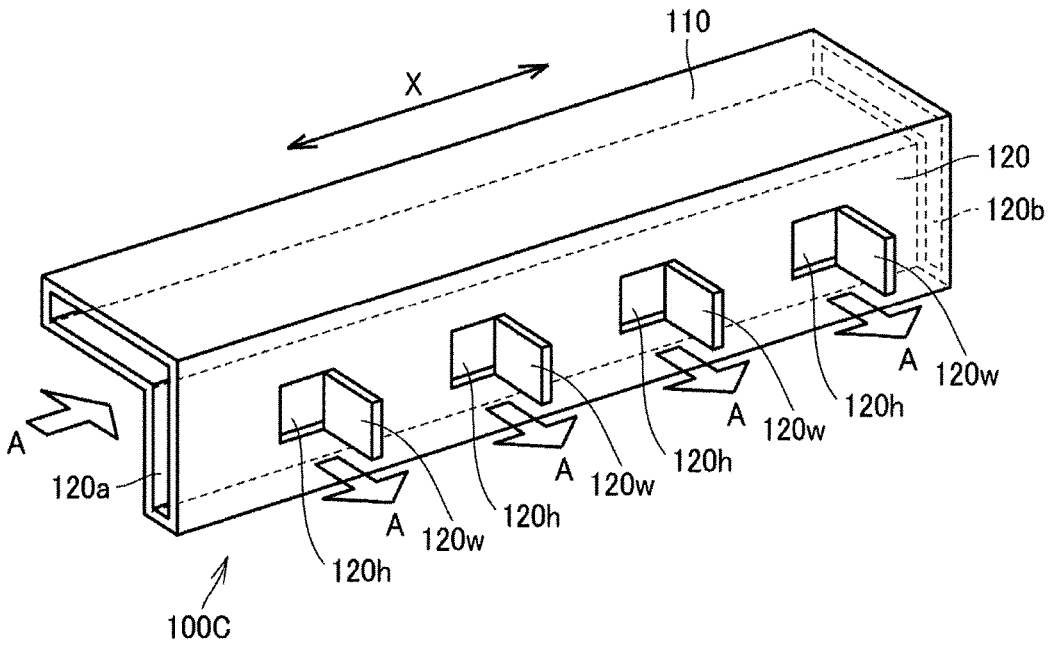
FIG. 8 is a general perspective view showing the configuration of only a heat insulation duct according to a fifth embodiment.

With reference to FIG. 8, an image forming apparatus 1 according to a fifth embodiment will be described. The difference between the image forming apparatuses 1 of the first and fifth embodiments is that guide walls 120W extending in a direction intersecting the direction indicated by the arrow X in the drawing are provided in the vicinities of the main body opening portions 120*h* on the surface of a heat insulation duct 100C at the downstream side of the air flow. FIG. 8 is a general perspective view showing the configuration of only the heat insulation duct 100C.

Since the air flowing in the heat insulation duct 100C follows the direction of the air flowing in the longitudinal direction (axial direction), the air tends to concentrate on the downstream side. Thereupon, by providing the guide walls 120W, the air discharged from the main body opening portions 120*h* can be easily led to the outside. Thus, it is possible to suppress the concentration of the air at the downstream side and expect more effective heat insulation effect between the fixing apparatus 7 and the image former 4. Note that, by projecting parts of the guide walls 120W toward the inside of the heat insulation duct 100C, the air flowing in the heat insulation duct 100C can be led more to the outside.

Sixth Embodiment

Figure 9:
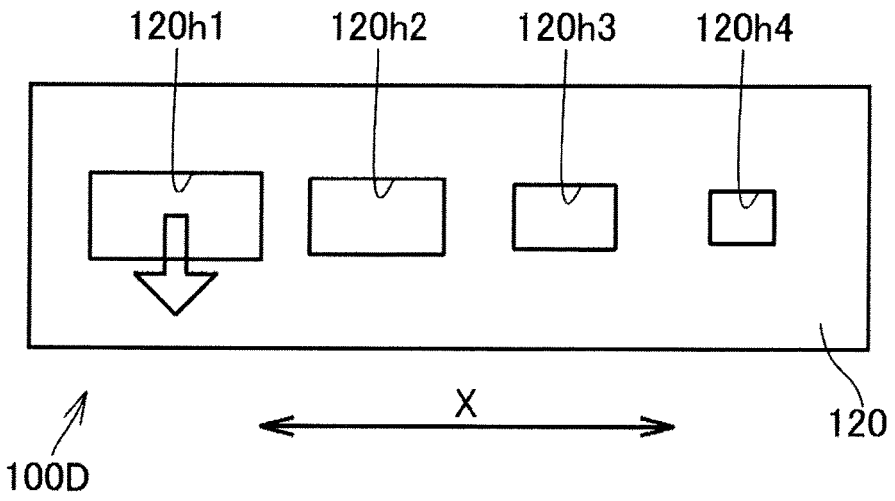
FIG. 9 is a diagram showing the configuration of only a heat insulation duct according to a sixth embodiment.

With reference to FIG. 9, an image forming apparatus 1 according to a sixth embodiment will be described. The differences between the image forming apparatuses 1 of the first and sixth embodiments are shapes of the main body opening portions 120*h* provided in a heat insulation duct 100D. FIG. 9 is a diagram showing the configuration of only the heat insulation duct 100D.

Since the air flowing in the heat insulation duct 100D follows the direction of the air flowing in the longitudinal direction (axial direction X), the air volume increases on the downstream side. Thereupon, the shapes of the main body opening portions 120*h* are made larger in the opening areas at the upstream side and made smaller in the opening areas at the downstream side. More specifically, the opening areas are reduced in order of a main body opening portion 120*h*1, a main body opening portion 120*h*2, a main body opening portion 120*h*3 and a main body opening portion 120*h*4. Thus, it is possible to balance the air discharged from the main body opening portion 120*h* and prevent occurrence of a place where the hot air warmed by the fixing apparatus 7 locally reaches the image former 4.

Seventh Embodiment

Figure 10:
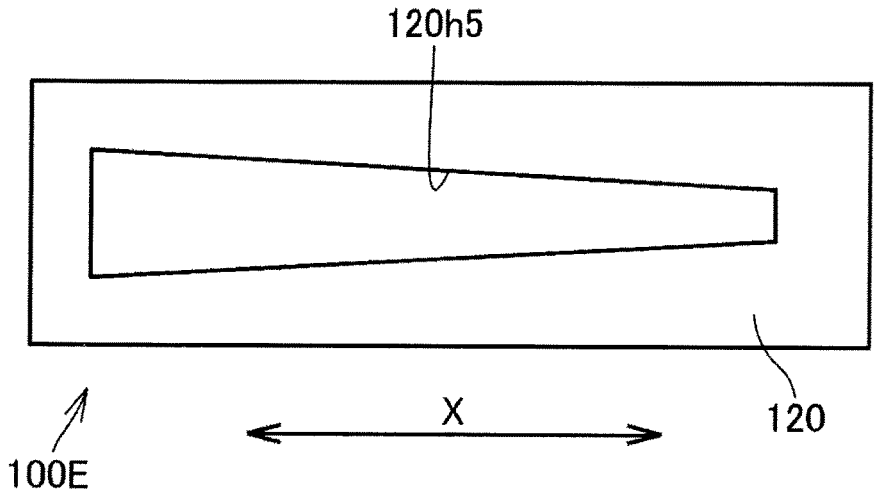
FIG. 10 is a diagram showing the configuration of only a heat insulation duct according to a seventh embodiment.

With reference to FIG. 10, an image forming apparatus 1 according to a seventh embodiment will be described. The difference between the image forming apparatuses 1 of the first and seventh embodiments is the shape of the main body opening portion 120*h* provided in a heat insulation duct 100E. FIG. 10 is a diagram showing the configuration of only the heat insulation duct 100E.

As described above, since the air flowing in the heat insulation duct 100E follows the direction of the air flowing in the longitudinal direction (axial direction X), the air volume increases on the downstream side. Thereupon, when the shape of the main body opening portion 120*h* is viewed along the axial direction X, the opening area per unit length is provided to be smaller on the downstream side than on the upstream side.

More specifically, a main body opening portion 120*h*5 is provided so that the interval between the upper side and the lower side gradually decreases from the upstream side to the downstream side. Thus, it is possible to balance the air discharged from the main body opening portion 120*h*5 and prevent occurrence of a place where the hot air warmed by the fixing apparatus 7 locally reaches the image former 4.

Eighth Embodiment

Figure 11:
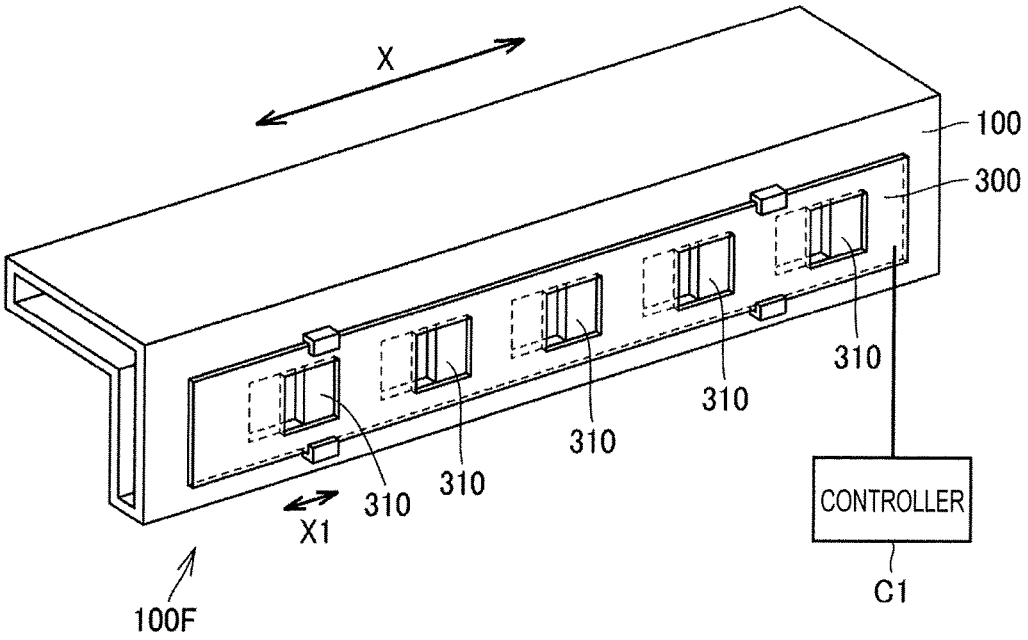
FIG. 11 is a diagram showing the configuration of only a heat insulation duct according to an eighth embodiment.

With reference to FIG. 11, an image forming apparatus 1 according to an eighth embodiment will be described. The difference between the image forming apparatuses 1 of the first and eighth embodiments is that a shutter mechanism 300 for opening and closing a main body opening portion 120*h* is provided in the main body opening portion 120*h* provided in a heat insulation duct 100F. FIG. 11 is a diagram showing the configuration of only the heat insulation duct 100F.

When the sheet P enters the fixing nip portion of the fixing apparatus 7 and there is an air flow, there is concern that the leading edge of the sheet P may flutter and cannot stably enter the nip portion. Thereupon, by providing the shutter mechanism 300 having windows 310 for opening and closing the main body opening portion 120*h*, it is possible to adjust the amount of the air discharged from the main body opening portion 120*h*.

Moreover, by providing a drive mechanism capable of opening and closing the windows 310 of the shutter mechanism 300 and controlling the drive mechanism of the shutter mechanism 300 by a controller C1 of the image forming apparatus 1 so that the air volume from the main body opening portion 120*h* becomes smaller than the maximum value at least when the leading edge of the sheet P enters the fixing apparatus 7, it is possible to suppress the hot air warmed by the fixing apparatus 7 from reaching the image former 4 while preventing the fluttering of the leading end of the sheet P.

Although embodiments of the present invention have been described and illustrated in detail, the disclosed embodiments are made for purposes of illustration and example only and not limitation. The scope of the present invention should be interpreted by terms of the appended claims and intended to include all modifications within the meaning and scope equivalent to the claims.

What is claimed is:

1. An image forming apparatus comprising:

an image former that includes an imaging part that forms a toner image, a transferrer that transfers the toner image onto a sheet, and a transfer belt;

a fixing apparatus that fixes the toner image transferred to the sheet by a heating roller and a pressure roller extending in an axial direction, the transfer belt from the transferrer to the imaging part being disposed to at least partially surround an upper side of the fixing apparatus and an upstream side, relative to a sheet conveyance direction, of the fixing apparatus; and a first heat insulation duct that is disposed between the upper side of the fixing apparatus and the transfer belt and introduces a cooling medium therein along the axial direction and a second heat insulation duct that is used together with the first duct, is disposed between the upstream side of the fixing apparatus and the transfer belt, and introduces the cooling medium therein along the axial direction, wherein the second heat insulation duct has an opening portion that discharges the cooling medium introduced into the second heat insulation duct to a region between the image former and the fixing apparatus.

2. The image forming apparatus according to claim 1, wherein the opening portion is provided at a position facing the image former.

3. The image forming apparatus according to claim 1, wherein a fin that adjusts a flow direction of the cooling medium discharged from the opening portion is disposed between the second heat insulation duct and the image former.

4. The image forming apparatus according to claim 1, wherein a guide wall extending in a direction intersecting the axial direction is provided in a vicinity of the opening portion on a surface of the second heat insulation duct at a downstream side of a flow of the cooling medium.

5. The image forming apparatus according to claim 1, wherein the opening portion has an opening area per unit length provided to be smaller at a downstream side than the upstream side when viewed along the axial direction.

6. The image forming apparatus according to claim 5, wherein the opening area of the opening portion positioned at the upstream side is larger than the opening area of the opening portion positioned at the downstream side when viewed along a direction of a flow of the cooling medium.

7. The image forming apparatus according to claim 1, wherein the opening portion is provided at a position not facing the fixing apparatus.

8. The image forming apparatus according to claim 1, further comprising a shutter mechanism that opens and closes the opening portion.

9. The image forming apparatus according to claim 8, further comprising a controller, wherein the controller controls the shutter mechanism so that an air volume from the opening portion is made smaller than a maximum value at least when a leading edge of the sheet enters the fixing apparatus.

10. The image forming apparatus according to claim 1, wherein the image former includes a cleaner that removes toner remaining on the transferrer after the toner image is transferred onto the sheet.

11. The image forming apparatus according to claim 1, wherein a width of the first heat insulation duct in the axial direction is longer than at least a width of the fixing apparatus.

12. The image forming apparatus according to claim 1, wherein a width of the second heat insulation duct in the axial direction is longer than at least a width of the fixing apparatus.

* * * * *